United States Patent [19]

Gomez-Marcial

[11] Patent Number: 4,862,534

[45] Date of Patent: Sep. 5, 1989

[54] INSECT NETTING FOR A CRIB OR THE LIKE

[76] Inventor: Antonio Gomez-Marcial, Presidente Ramirez 207, Baldrich Hato Rey, San Juan

[21] Appl. No.: 81,700

[22] Filed: Aug. 5, 1987

[51] Int. Cl.[4] ..... A47C 29/00

[52] U.S. Cl. ..... 5/414; 5/97

[58] Field of Search ..... 5/414, 415, 416, 97, 5/98 C; D6/391

[56] References Cited

U.S. PATENT DOCUMENTS

| | | | |
|---|---|---|---|
| 678,197 | 7/1901 | Price | 5/414 |
| 2,155,209 | 4/1939 | Walker | 5/414 |
| 2,301,511 | 11/1942 | Boyce | 5/414 X |
| 2,586,247 | 2/1952 | Mover | 5/97 |
| 2,667,648 | 2/1954 | Donovan | 5/98 CX |
| 2,737,193 | 3/1956 | Boyd | 5/414 |
| 2,840,093 | 6/1958 | Matthews | 5/414 X |
| 2,883,678 | 4/1959 | Heffernan et al. | 5/97 X |
| 2,927,331 | 3/1960 | Ruiz | 5/414 |
| 3,145,396 | 8/1964 | Zindell | 5/97 |
| 4,489,451 | 12/1984 | Neely | 5/414 |

FOREIGN PATENT DOCUMENTS

| | | | |
|---|---|---|---|
| 0209496 | 1/1924 | United Kingdom | 5/414 |

*Primary Examiner*—Ramon O. Ramirez

*Attorney, Agent, or Firm*—Scrivener and Clarke

[57] ABSTRACT

A netting defines an enclosure for a crib or the like having four sides and a top of open weave fabric, and an open bottom, the lower corners of the sides are sewn in puckered relationship to elastic material to define elasticized corner flaps which can be snapped beneath the corners of a mattress similarly to so called "fitted" lower sheets whereby the netting can be easily installed or removed without disturbing an occupant of a crib or the like. Preferably the lower parts of the sides and end panels are of close weave fabric and the corner flaps are formed in this fabric. Fasteners are provided for retaining the enclosure in an extended position above the mattress.

10 Claims, 2 Drawing Sheets

INSECT NETTING FOR A CRIB OR THE LIKE

This invention relates to insect netting for a crib or the like and more particularly to insect netting which may be easily anchored in or removed from its positions of use with a minimum of disturbance to the occupant of the crib or other resting place, such as a bed, with which the netting may be used.

BACKGROUND OF THE INVENTION

Though it will be apparent that the present invention may be used with any type of bed, it will be described in connection with its use as an insect netting for a crib. Insect netting for cribs are, of course, well known, the U.S. Pat. Nos. to Mover 2,586,247 and Ruiz 2,927,331 being representative. Mover is not a crib netting as such but is an entire crib whose walls are made of netting. Ruiz, however, is concerned with a netting which may be used with a conventional crib and has in common with Mover a lower panel or crib bottom that extends entirely beneath the crib mattress. The drawback of a netting that extends entirely beneath the mattress is the fact that it is almost impossible to install or remove the netting while the crib is occupied. A possible solution to this problem would be to provide the side and end panels with flaps for tucking under the mattress as suggested, for example, in the patent to Neely U.S. Pat. No. 4,489,451. The problem with flaps is that they can't be sewn together along adjacent edges and furthermore, an active toddler can easily pull the flaps out and thus negate the usefulness of the netting as a protection against insects.

BRIEF DESCRIPTION OF THE INVENTION

It is an object of the present invention to overcome the problems with crib netting as outlined above by forming the lower corners of the netting similarly to the elasticized corners of so-called "fitted" lower sheets used with conventional mattresses. The invention not only permits the netting to be easily installed or removed with negligible disturbance to a sleeping child in the crib, but after it has been installed it is effectively anchored against accidental displacement by an active toddler in the crib.

DETAILED DESCRIPTION OF THE INVENTION

Figure 1:
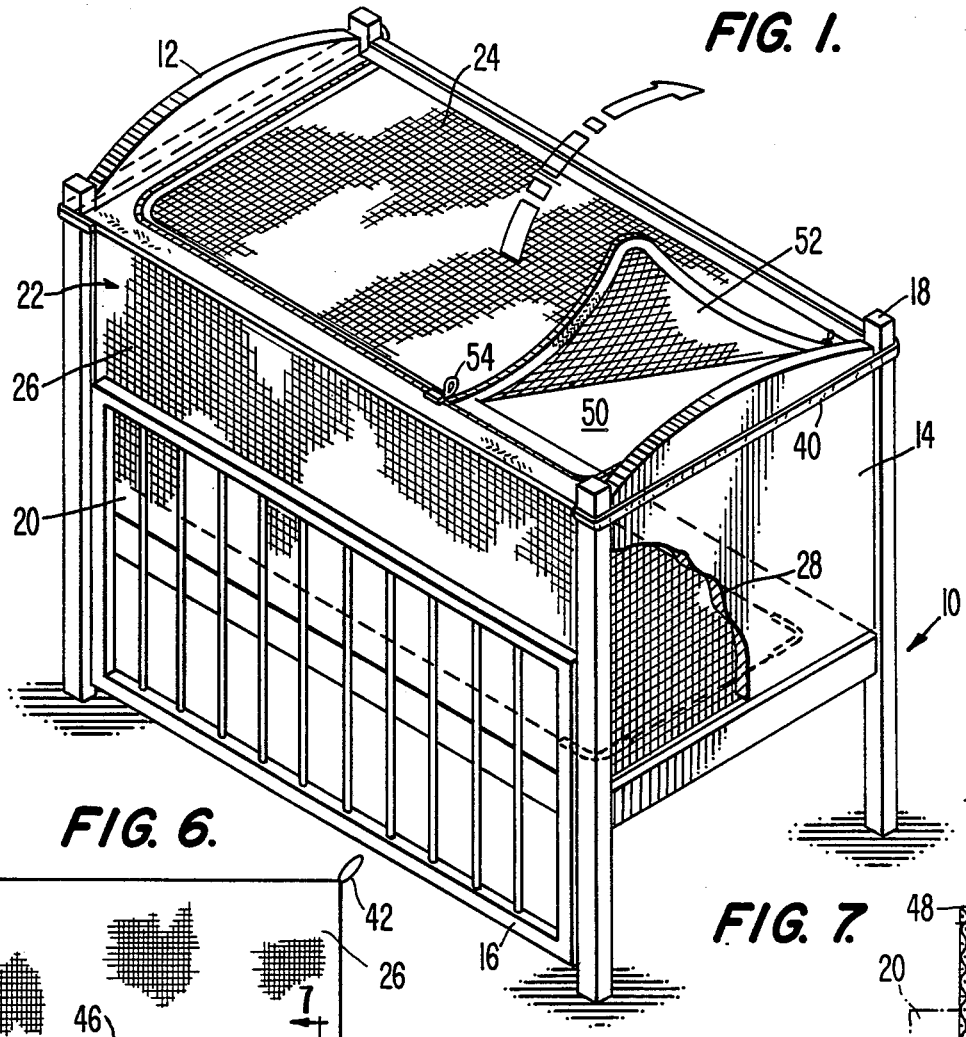
FIG. 1 is a perspective view of a crib fitted with an insect netting embracing the present invention.

Referring now to the drawings, the numeral 10 refers to a conventional rectangular crib having a head 12 a foot 14, slideable sides 16, and corner posts 18. The crib includes vertically adjustable springs (not shown) supporting a crib mattress 20.

Figure 6:
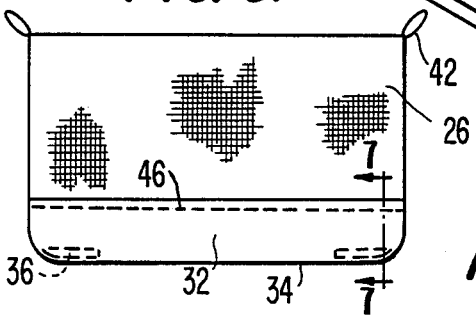
FIG. 6 is a side elevational view on a reduced scale showing a preferred construction for the netting of the present invention.

The insect netting constituting the present invention is generally designated at 22 and comprises a top panel 24 and pairs of side and end panels 26, 28 of open weave fabric defining in its position of use within a crib or the like a rectangular enclosure having an open bottom 30 (see FIG. 7) and horizontal cross-sectional dimensions complementary to the corresponding dimensions of the mattress 20. The side and end panels 26, 28 have lower parts 32, which may be of a different material from the open weave material as further explained below, having bottom edges 34, FIGS. 6 and 7. Elastic material 36, specifically, well-known elastic tape, connects the ends of the bottom edges 34 of the respective lower parts 32 of the panels in a puckered relationship to define at each lower corner of the enclosure inwardly extending corner flaps 38 which, when the elastic material is manually stretched, as is permitted by the puckering of the material at the corners, may be snapped under the corners of a mattress when the elastic material is relaxed in a manner similar to the corners of so-called "fitted" lower sheets now generally in use.

Figure 4:
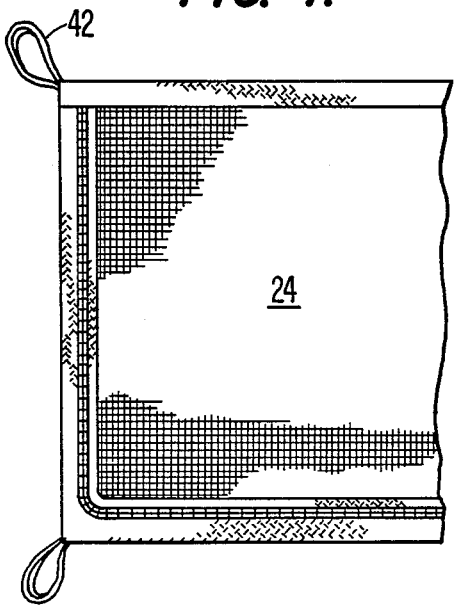
FIGS. 4 and 5 are broken top-plan views showing alternate means for releasably retaining the netting in its position of use.
Figure 5:
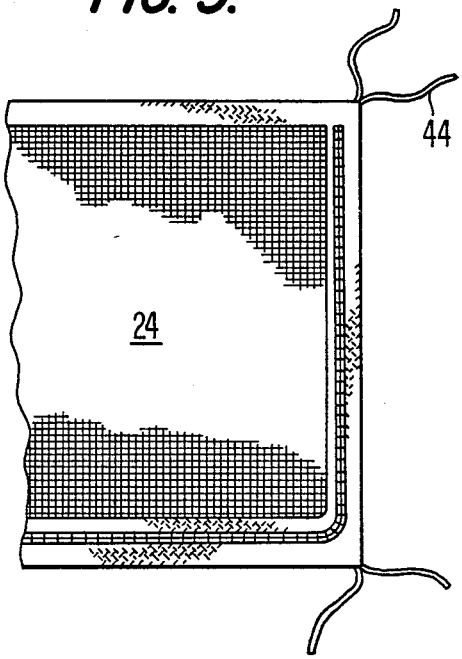

Means are provided for releasably retaining the enclosure in the extended position of FIG. 1 above the mattress 20 after the corner flaps 38 have been positioned beneath the corners of the mattress. In FIG. 1, the retaining means comprise end straps 40, preferably elastically stretchable, which are adapted to be placed over the upper ends of the head and foot of a crib. Instead of, or in addition to, the straps 40, loops 42, FIG. 4, can be provided at each corner of the enclosure for engagement with the extending ends of the corner posts 18 of the crib. Instead of loops, ties 44, as shown in FIG. 5, can be provided at the ends of the enclosure for tieing to adjacent parts of a crib as for example to end bars.

Figure 7:
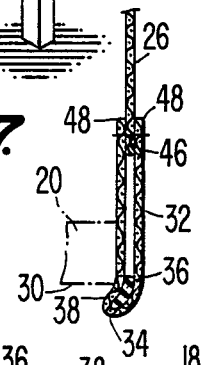
FIG. 7 is an enlarged, somewhat exaggerated vertical cross-sectional view taken substantially on the lines 7—7 of FIG. 6.

Though the side and end panels can be of a uniform open weave material from top to bottom, preferably the lower parts 32 are a close weave fabric, similar or identical to conventional broad cloth bed sheets, having upper and lower edges, the upper edge being sewn by a line of stitching 46 to the lower edge of the open weave fabric, the corner flaps 38 being formed in the lower edge of the close weave fabric. Desirably the close weave fabric lower portion 32 is folded in a substantial U-shape, as shown exaggeratedly in FIG. 7, having two free upper edges 48 which sandwich therebetween the lower edge of the open weave fabric with the line of stitching 46 joining the three together. As can be seen in FIG. 7, the elastic material 36 is disposed in the bottom of the U-shaped fold of the close weave material with stitching joining the elastic material to the close weave fabric in the puckered relationship to define the corner flaps 38.

Figure 2:
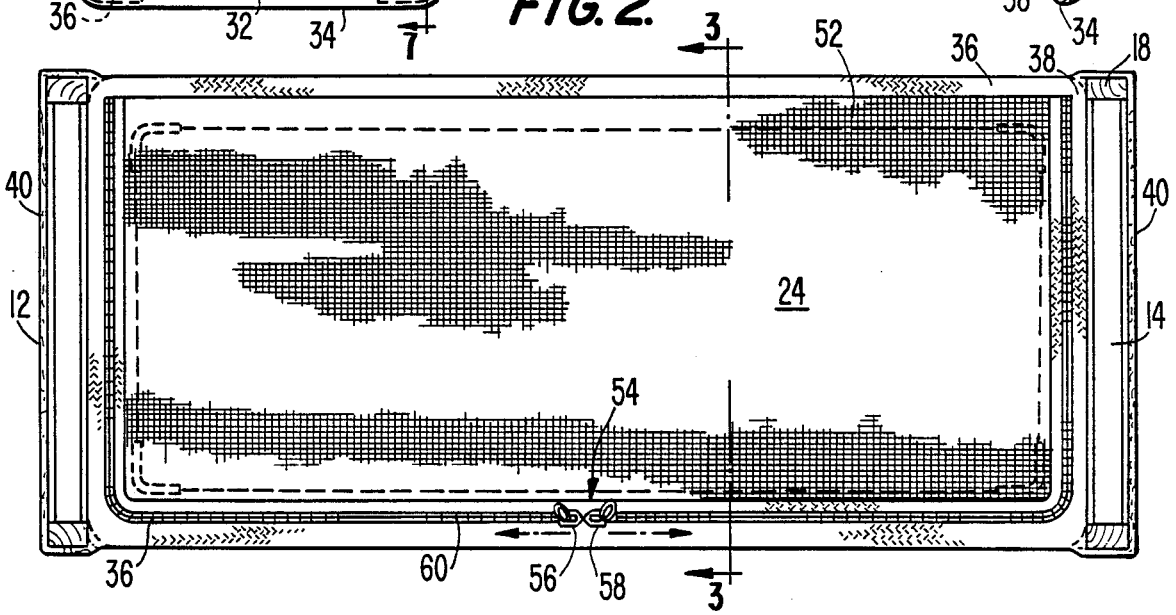
FIG. 2 is a top-plan view of the crib and netting of FIG. 1.

The top panel 24 of the enclosure includes an opening 50 as seen in FIG. 1 and a flap 52 normally closes the opening, slide fastening means 54 releasably holding the flap 52 in its closed position. As can be seen in FIG. 2, the slide fastening means may comprise a pair of sliders 56, 58 either or both of which can be operated to engage or disengage the teeth of the fastener track 60 which extends around three sides of the closure flap 52.

Figure 3:
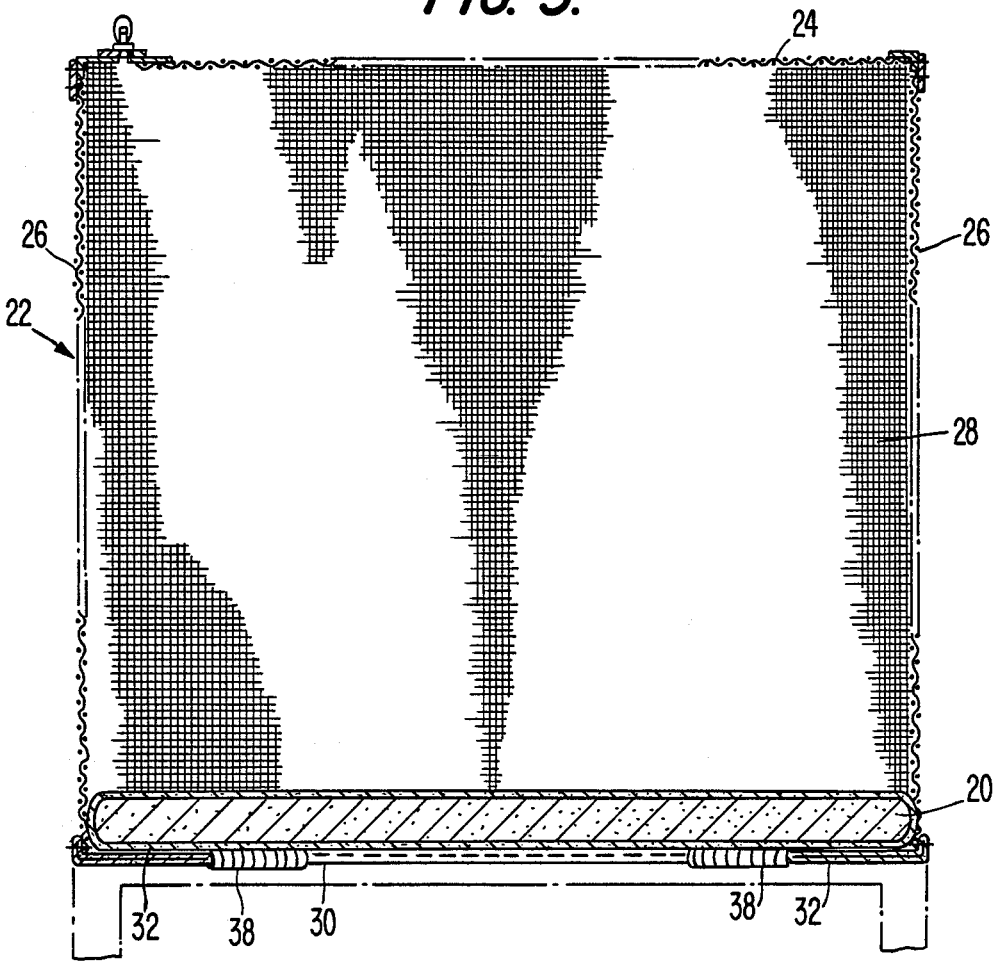
FIG. 3 is an enlarged vertical cross-sectional view taken substantially on the line 3—3 of FIG. 2.

In use and assuming an infant is asleep on the mattress and insects appear, the enclosure is draped over the crib mattress and attached to the crib in extended position by use of the fastening means 40, 42 or 44. The corner flaps 38 are then snapped under the mattress corners which may require no lifting of the mattress corners whereby the infant is undisturbed. One then tucks the lower edges of the lower parts of the sides and end panels beneath the mattress from the outside as with conventional "fitted" sheets. Desirably, where close weave fabric is used as the lower parts of the side and end panels, that fabric has a vertical width which, when it is tucked beneath the mattress, does not extend above the sides of the mattress and preferably occupies a position entirely beneath the mattress as can be seen in FIG. 3. If, for any reason it is found desirable to remove the netting, an adult can easily snap the corner flaps clear of the mattress corners and simply lift the enclosure clear of the crib without disturbing the occupant.

Though most cribs are of a standard size thus permitting the use of the corner loops 42 or the straps 40, where the crib mattress is normally positioned below the usual position relative to upper edges of the crib sides the ties 44 can be adjusted to ensure that the corner flaps are properly received beneath the corners of the mattress while the enclosure is supported in its full extended height above the mattress.

The netting of the invention is in production and sale and is in significant demand believed due in a large part to the ease with which it can be installed or removed with minimum or no disturbance to an occupant of the crib.

Though the invention is described in connection with its use as a crib mattress, merely by increasing its size it can be used equally well with a full sized bed and such use is intended to be included within the purview of the appended claims.

What is claimed is:

1. An insect netting for a crib of the type having a head, foot, sides, springs and a mattress comprising a top panel, and pairs of side and end panels, said panels being of open weave fabric defining in their position of use a rectangular enclosure having an open bottom and horizontal cross sectional dimensions complementary to the corresponding dimensions of a crib mattress, the side and end panels having lower parts having bottom edges, elastic material connecting the ends of the bottom edges of the respective lower parts of said panels in a puckered relationship to define at each lower corner of said enclosure inwardly extending corner flaps which when said elastic material is manually stretched may be snapped under the corners of a mattress when said elastic material is relaxed, and means, engageable with the head and foot of a crib for releasably retaining said enclosure in an extended position above a mattress after said corner flaps have been positioned beneath the corners of said mattress.

2. The insect netting of claim 1, wherein the lower parts of said side and end panels is a close weave fabric having upper and lower edges, the upper edge being sewn to a lower edge of said open weave fabric and said corner flaps being formed in the lower edge of said close weave fabric.

3. The insect netting of claim 2, wherein the close weave fabric is folded in a substantially U-shaped having two free under edges sandwiching therebetween the lower edge of the open weave fabric, and a line of stitching joining said edges together.

4. The insect netting of claim 3, wherein the elastic material is disposed in the bottom of the U-shaped fold of the close weave fabric, and switching joining said elastic material to said close weave fabric in said puckered relationship to define said corner flaps.

5. The insect netting of claim 1, wherein said top panel includes an opening, a flap normally closing said opening, and slide fastening means for releasably holding said flap in a closed position.

6. The insect netting of claim 1, wherein the means for releasably retaining said enclosure in an extended position comprises end straps adapted to be placed over the upper ends of the head and foot of a crib.

7. The insect netting of claim 6, wherein said straps are elastically stretchable.

8. The insect netting of claim 1, wherein the means releasably retaining said enclosure in an extended position comprises loops at each upper corner of said enclosure for engagement with extending ends of corner posts of a crib.

9. The insect netting of claim 1, wherein the means for releasably retaining said enclosure in an extended position comprises ties at the ends of said enclosure for tieing to adjacent parts of a crib.

10. An insect netting for a crib of the type having a spring and a mattress supported on said spring, a head and foot elevated above said mattress and a pair of sides, said netting comprising a top panel and pairs of side and end panels, said panels being of open weave fabric and being connected together along their contiguous edges to define in their position of use a rectangular enclosure of a size to be received entirely within the space defined by the head, foot and sides of a crib, said enclosure having an open bottom and horizontal cross-sectional dimensions complementary to the corresponding dimensions of a crib mattress, the side and end panels having lower parts having bottom edges, elastic material connecting the adjacent ends of the bottom edges of the lower parts of said panels in a puckered relationship to define at each lower corner of said enclosure inwardly extending corner flaps which when said elastic material is manually stretched may be snapped under the corners of a mattress when said elastic material is relaxed, and means engageable with the head and foot of a crib for releasably retaining said enclosure in an extended position entirely within the space defined by the head, foot and sides of the crib when said corner flaps have been positioned beneath the corners of a mattress.

* * * * *